US012208980B2

(12) United States Patent
Perini et al.

(10) Patent No.: US 12,208,980 B2
(45) **Date of Patent: *Jan. 28, 2025**

(54) REWINDING MACHINE AND METHOD FOR THE PRODUCTION OF LOGS OF PAPER MATERIAL

(71) Applicant: FUTURA S.P.A., Capannori (IT)

(72) Inventors: Fabio Perini, Viareggio (IT); Andrea Catalini, Porcari (IT); Frrok Lleshi, Lucca (IT)

(73) Assignee: FUTURA S.P.A., Capannori (IT)

( * ) Notice: Subject to any disclaimer, the term of this patent is extended or adjusted under 35 U.S.C. 154(b) by 280 days.

This patent is subject to a terminal disclaimer.

(21) Appl. No.: 17/776,783

(22) PCT Filed: Dec. 5, 2020

(86) PCT No.: PCT/IT2020/050303

§ 371 (c)(1),
(2) Date: May 13, 2022

(87) PCT Pub. No.: WO2021/130789

PCT Pub. Date: Jul. 1, 2021

(65) Prior Publication Data

US 2022/0402719 A1 Dec. 22, 2022

(30) Foreign Application Priority Data

Dec. 23, 2019 (IT) ..... 102019000025297

(51) Int. Cl.
*B65H 19/29* (2006.01)
*B65H 19/22* (2006.01)
(Continued)

(52) U.S. Cl.
CPC ..... *B65H 19/29* (2013.01); *B65H 19/2269* (2013.01); *B65H 19/26* (2013.01);
(Continued)

(58) Field of Classification Search
CPC ..... B65H 19/26; B65H 19/29; B65H 19/286; B65H 19/2269; B65H 2201/414421; B65H 2408/235
See application file for complete search history.

(56) References Cited

U.S. PATENT DOCUMENTS 3,532,572 A * 10/1970 Herman ..... B65H 19/29 118/50
3,532,573 A * 10/1970 Herman ..... B65H 19/29 242/527.1

(Continued)

FOREIGN PATENT DOCUMENTS

| | | |
|---|---|---|
| EP | 2045201 A1 | 4/2009 |
| EP | 2084092 B1 | 7/2013 |
| GB | 1167767 A | 10/1969 |

OTHER PUBLICATIONS

International Search Report and Written Opinion issued on Feb. 9, 2021 in corresponding International Patent Application No. PCT/IT2020/050303; 8 pages.

*Primary Examiner* — Sang K Kim
(74) *Attorney, Agent, or Firm* — Maier & Maier, PLLC

(57) ABSTRACT

A rewinding machine for producing paper logs by winding a paper web, comprising: elements for feeding a paper web along a predetermined path at a predetermined feeding speed; web pre-cutting elements; web winding elements; web sizing elements, with a pad adapted to cyclically apply glue by contact on the web, the pad being mounted on a pad-holder device connected with a corresponding actuator. The web sizing elements are arranged upstream of a web winding station. The pad-holder device is controlled such that, when the pad contacts the web, the pad is moved with a speed lower than the speed of the web along the respective feeding path so as to cause a prolonged contact of the pad with the web while the pad and the web move.

12 Claims, 6 Drawing Sheets

(51) Int. Cl.
*B65H 19/26* (2006.01)
*B65H 19/28* (2006.01)

(52) U.S. Cl.
CPC ..... *B65H 19/286* (2013.01); *B65H 2301/414421* (2013.01); *B65H 2408/235* (2013.01)

(56) References Cited

U.S. PATENT DOCUMENTS

| | | | | |
|---|---|---|---|---|
| 7,523,884 | B2 * | 4/2009 | Gelli | B65H 19/267 242/532.3 |
| 8,136,473 | B2 * | 3/2012 | Tsai | B65H 19/29 118/212 |
| 8,424,481 | B2 * | 4/2013 | Tsai | B05C 1/0817 118/414 |
| 2006/0076450 | A1 | 4/2006 | Gelli et al. | |
| 2009/0025863 | A1 | 1/2009 | Tsai | |
| 2010/0129543 | A1 * | 5/2010 | Tsai | B05C 1/0817 118/264 |

* cited by examiner

REWINDING MACHINE AND METHOD FOR THE PRODUCTION OF LOGS OF PAPER MATERIAL

FIELD

The present invention relates to a rewinding machine and a method for the production of logs of paper material.

BACKGROUND

It is known that the production of logs of paper material, from which are obtained for example rolls of toilet paper or rolls of kitchen paper, involves feeding a web of paper, formed by one or more superimposed plies, over a predetermined path along which various operations are performed before forming the logs, included a transverse perforation of the web to form pre-cut lines which divide it in tear-off sheets. The formation of the logs normally involves the use of cardboard tubes, commonly called "cores", on whose surface a predetermined amount of glue to is distributed to allow gluing of the paper web on the cores gradually introduced into the machine that produces the logs, commonly called "rewinder". The glue is applied on the cores when they pass along a corresponding path comprising a terminal section commonly called "cradle" due to its concave conformation. The formation of the logs also involves the use of winding rollers which force each core to rotate around its own longitudinal axis thus determining the winding of the web on the same core. The process ends when a predetermined number of sheets is wound on the core, with the gluing of a flap of the last sheet on the underlying one of the thus formed roll (so-called "flap gluing" operation). When the predetermined number of sheets wrapped on the core is reached, the last sheet of the log being completed is separated from the first sheet of the next log, for example by means of compressed air directed to a corresponding pre cutting line. At this point, the log is unloaded from the rewinder. EP1700805 discloses a rewinding machine working according to the operating scheme described above. The logs are then conveyed to a buffer unit that supplies one or more cutting machines through which the cutting of the logs is carried out in order to obtain the rolls in the desired format.

EP2045201 describes a rewinder in which the application of the glue on the web for executing the flap gluing is made by a roller that is moved alternately to and from the paper web upstream of the winding rollers.

EP2084092B1 also describes a rewinder in which the application of the glue on the web for executing the flap gluing is made upstream of the winding rollers by means of a diverter which is cyclically in contact with the paper web to push the latter towards a fixed applicator roller placed on the opposite side.

GB1167767 also discloses a system for applying glue to a paper web by diverting the path followed by the web itself so that, due to the web path deviation, the web comes into connection with an applicator roller that is provided with a radial pad for distributing the glue on the paper web by contact.

US 2006/076450 A1 discloses a rewinding machine with a gluing device for gluing the final edge of the logs that is arranged and operated such that it distributes glue inside the winding station of the rewinding machine.

SUMMARY

The main object of the present invention is to improve the gluing of the closing flap, or final edge, of logs made of paper material.

It is known that, for the execution of a log with optimal characteristics, the gluing of the first sheet of the log on the core would require a different procedure than gluing the last sheet to complete the log. In fact, the glue used to bond the first sheet on the core should preferably be relatively light because it must keep the paper web bonded to the core only in the initial stages of winding; moreover, this glue must allow the complete detachment of the paper from the core being processed when it is used, without causing damages and paper waste. On the contrary, preferably, the glue used for gluing the final flap or final edge must be relatively firm because the glue must keep the last sheet on the underlying paper layer during all the phases following the flap gluing, i.e. it must keep the log formed in its wrapping conformation (with the flap properly glued) in the following phases of handling, possible temporary storage, and cutting of the log to obtain the paper rolls forming the final products; the gluing of the flap must also resist in the final packaging operations.

Among the purposes of the present invention there is therefore that of providing a rewinder and an operative method that allow to implement in an optimal way the above-mentioned operations.

This result has been achieved, in accordance with the present invention, by providing a rewinder and a method for the production of paper logs having the characteristics indicated in the independent claims. Other features of the present invention are the subject of dependent claims.

Among the advantages offered by the present invention, the following can be listed: it is possible to use glues of a different type and/or viscosity or formulation for gluing the paper web on the core at the start of winding and respectively the final flap of the log being completed; the dispensing of the glue is extremely precise: if colored glues are used it is possible to form drawings on the web during the gluing the flap; it is possible to reduce the risk of the flap glue spreading uncontrollably inside the rewinder and on the web during rewinding.

BRIEF DESCRIPTION OF THE DRAWINGS

The aforementioned advantages and characteristics of the present invention will be more and better understood by each person skilled in the art thanks to the description that follows and the annexed drawings, provided by way of example but not to be considered in a limiting sense, in which.

DETAILED DESCRIPTION OF THE EMBODIMENTS

Figure 1:
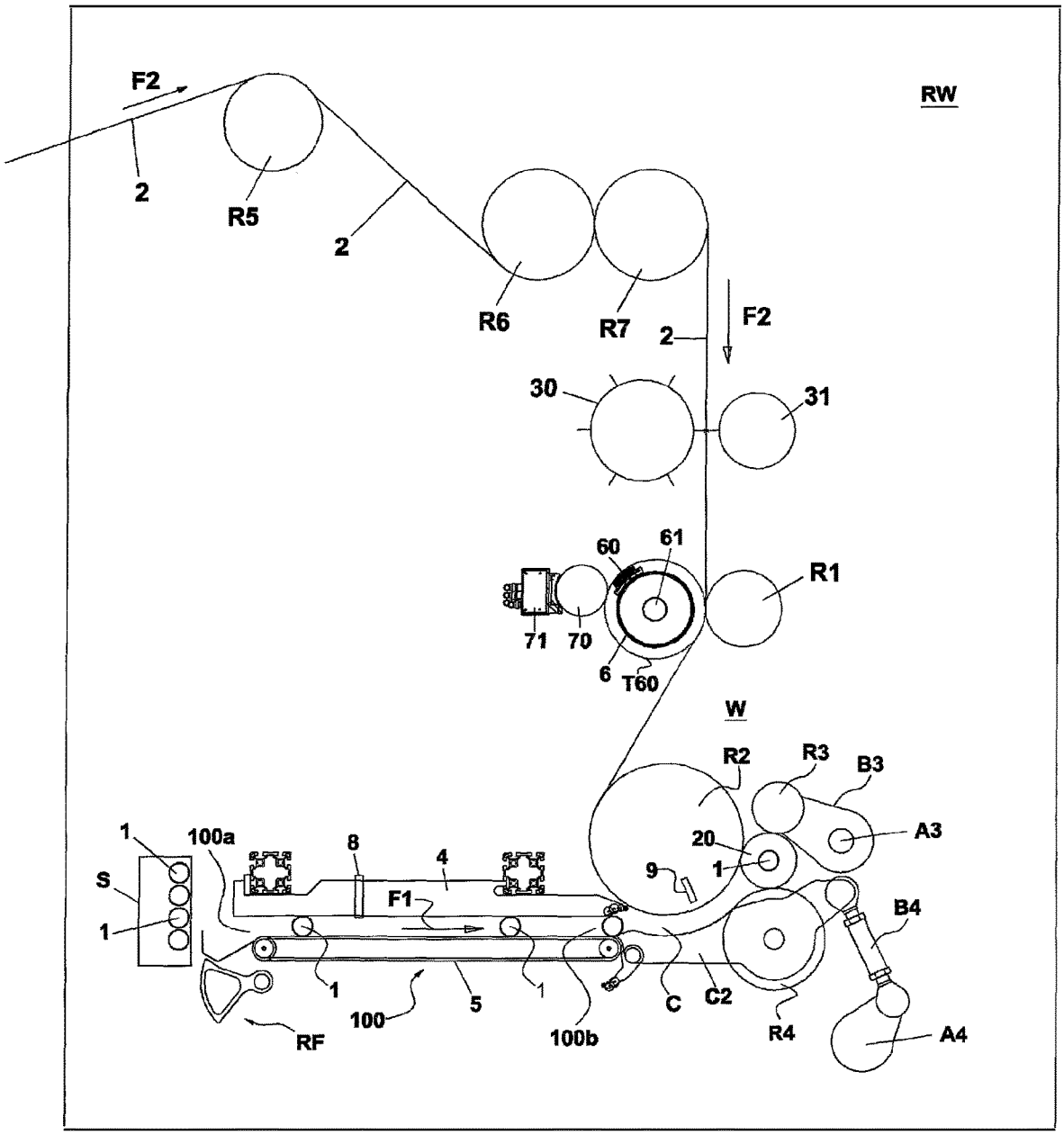
FIG. 1 is a schematic side view of a machine according to the present invention.

With reference to the annexed drawings, a rewinder (RW) for the production of logs made of paper material according to the present invention is the type comprising: means (R1, R2, R5, R6, R7) for feeding a continuous web of paper material (2) along a first predetermined path; means (30, 31) adapted for making a series of discontinuous transversal cuts for dividing the web (2) into tear-off sheets of predetermined length; means for feeding tubular cores (1) along a second predetermined path that joins to said first path in correspondence of a coupling channel (C) in which said cores (1) are associated to said web (2), said channel (C) being arranged upstream of a winding station or log formation station (W) in which, on each of said cores (2), is wound a predetermined amount of said web (2) comprising a head end, defining the first sheet, and a tail end, defining the last sheet of the log; and first sizing means adapted to release a predetermined amount of glue for gluing the first sheet on the core (1) and second sizing means adapted to release a predetermined amount of glue intended for gluing the last sheet of the log on the underlying paper layer of the same log, i.e. for completing the log.

With reference to the examples shown in the drawings, the means (R1, R2, R5, R6, R7) for feeding the web (2) along the first predetermined path comprise a plurality of web-guiding rollers arranged with their rotation axes parallel to each other. In particular, these rollers are arranged with their respective axes oriented horizontally according to scheme known per se to those skilled in the art. One of said rollers (R2) is placed in the winding station (W) and at the same time it is both an end roller guiding the web (2) and a winding roller, i.e. a roller which, in cooperation with others rollers, determines the winding of the web (2) around the cores (1) which gradually reach the winding station (W). For this reason, the roller (R2) will be referred as "first winding roller" in the following.

With reference to the examples shown in the drawings, the means for providing the discontinuous transversal cuts on the web (2) may consist of two cutting rollers (30, 31) with horizontal axis of the known type, arranged opposite to the two sides of the path followed by the web (2), downstream of a series of web-guide rollers (R5, R6, R7) arranged upstream in relation to the direction followed by the web (2). The web-guide rollers (R5, R6, R7) can, in turn, receive the web from one or more reels placed upstream, such that the web (2) is made up of a single paper ply or more superimposed paper plies according to known methods that therefore not further described. In the drawings, the direction of origin of the web (2) is denoted by arrows "F2".

Downstream of the pre-cutting station formed by the two opposing cutting rollers (30, 31) the web (2) is therefore provided with pre-cutting lines allowing a controlled tearing of the web that, in this way, is divided into tear-off sheets.

The coupling channel (C) also has a substantially known structure: it is defined by a lower concave structure (C2) arranged below and opposite to the first winder roller (R2). The channel (C) is open upstream, i.e. in correspondence with the output (100B) of the device (100) for moving the cores (1), described below, and it ends, downstream, in the winding station (W).

In the winding station (W) there are two other winding rollers (R3, R4) having a horizontal axis, that cooperate with the first winding roller (R2) according to a mechanism known per se: in practice, by rotating with a predetermined angular speed and direction each around its own longitudinal axis, the rollers (R2, R3, R4) determine the winding of a predetermined amount of web (2) around each core (1) that reaches the winding station (W). In accordance with the example shown in the drawings and according to a mechanical configuration known per se, the other two winding rollers (R3) and (R4) that are located downstream of the aforementioned channel (C) with respect to the direction (FI1) of origin of the cores (1) and are arranged opposite to each other. According to the example shown in the drawings, the roller (R3) and the roller (R4) are placed on respective arms (B3, B4) each connected with an actuator (A3, A4) allowing the movement of these rollers to and from the arrival point of the cores (1). The longitudinal axes of the rollers (R2, R3, R4) are parallel to each other.

In accordance with the example shown in the drawings, the first sizing means comprise a glue dispenser (8) located and acting in correspondence with a device (100) for feeding the cores (1) arranged upstream of the winding station (W) and upstream of the coupling channel (C).

In practice, the cores (1) are moved by a feeding device (100) of known type that carries the cores (1) to the coupling channel (C), the cores coming from a core storing area (S) located upstream and constituted, for example, by a core store, a core buffer or other similar equipment. For example, in accordance with a mechanical configuration known per se, the device (100) that supplies the cores (1) to the winding station (W) consists of a plurality of lower annular belts (5) arranged side by side and a plurality of upper fixed plates (4) also arranged side by side, so as to provide a lower support for the cores (1) and, at the same time, to move the cores by making them to roll along the aforementioned direction (F1). The reference "RF" in the drawings denotes a mechanical feeder, of the known type, which picks up the cores (1) from the core storing area (S) and inserts them into the feeding device (100).

According to the example shown in the drawings, the device (100) moves each core (1) downstream, making it to pass from an inlet (100A) to an outlet (100B) that ends in the coupling channel (C) where the core (1) is joined to said head end of the portion of web (2) destined to the log being formed. In practice, the core (1) already subjected to the action of the glue dispenser (8) enters the channel (C) where the glue applied on the core itself (1) determines the coupling with a first sheet or head end of the web (2) which reaches the channel because it is dragged around the roller (R2). The roller (R2) is provided with a mechanism (9) adapted to determine the separation of the portion of the web (2) that has formed the log being completed and the portion of the web (2) which is going to form the next log. Said mechanism (9) can be constituted by a plurality of nozzles distributed along the length of the log provided inside the roller (R2) and adapted to direct a jet of air through corresponding perforated parts of the roller (R2), as known for example from EP1700805.

In a rewinder (RW) according to the invention, the second sizing means are arranged and acting upstream of said coupling channel (C) and comprise a roller (6) provided with a pad (60) adapted to release glue on said web (2) by contact. The roller (6) will be referred to as the pad-holding roller in the following.

With reference to the example shown in the drawings, the pad-holding roller (6) is opposed to a web-guide roller (R1) guiding the web (2) which, in this way, acts as a counter support roller for the web itself when applying the glue. The pad-holder roller (6) is parallel to the guide roller (R1) and to the winding rollers (R2, R3, R4) and is connected to a respective rotary actuator (schematically denoted by reference "61" in the drawings) that controls thereof rotation around its own longitudinal axis. The dotted circular line indicated by the reference "T60" in the drawings shows the circular trajectory followed by the pad (60) when the pad-holder roller (6) is rotated.

According to an embodiment shown in the drawings, said pad (60) is a body protruding radially from the external surface of the pad-holder roller (6); in other words, the pad (60) is a radial appendix of the pad-holder roller (6).

In accordance with the example shown in the drawings, the pad-holder roller (6) is disposed and acting between a glue dispensing device (7) and the counter-roller (R1).

The glue dispensing device (7) comprises a tank (71) to which is associated with an anilox roller (70) intended to transfer the glue onto the pad (60). In practice, the roller (6) that supports the pad (60) is spaced by such a distance from the anilox roller (70) to determine the cyclic interaction of the pad (60) with the anilox roller (70) for transferring the glue on the pad itself. The pad (60) impregnated with the glue cyclically enters in contact with the web (2) coming from the guide roller (R1) arranged upstream. The contact between the pad (60) and the web (2) is facilitated by the fact that the web rests against the roller (R1) during said contact.

Figure 7:
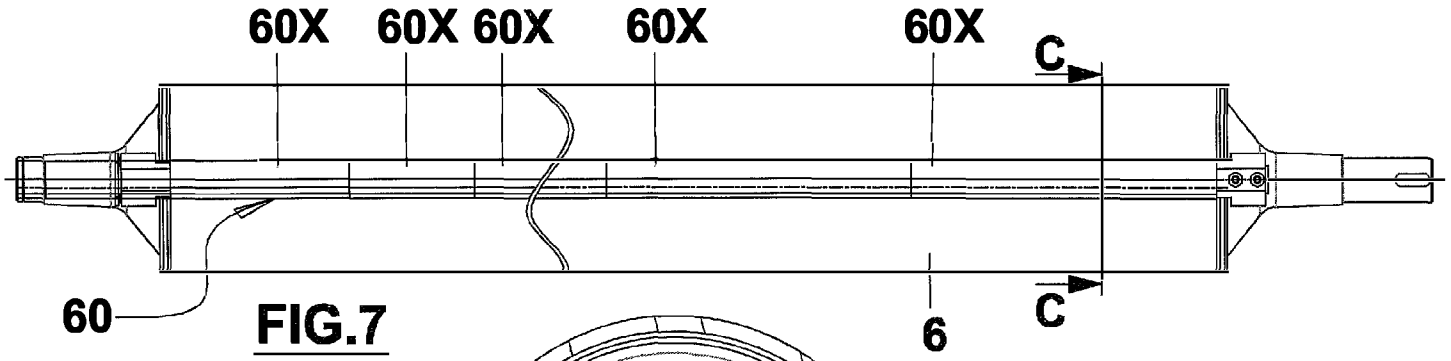
Figure 8:
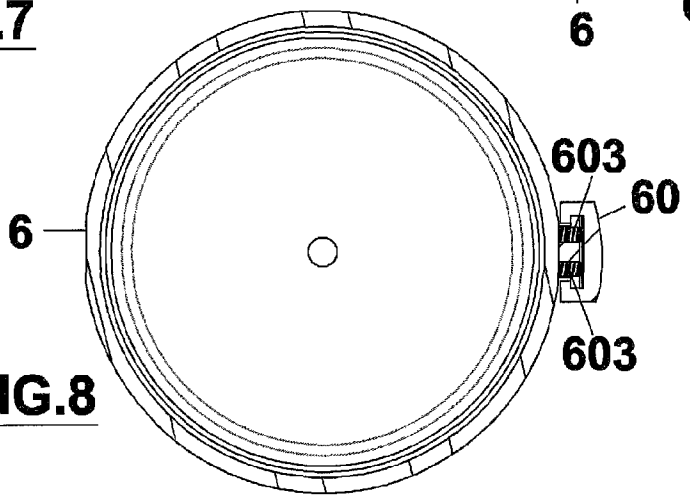
Figures 9, 10:
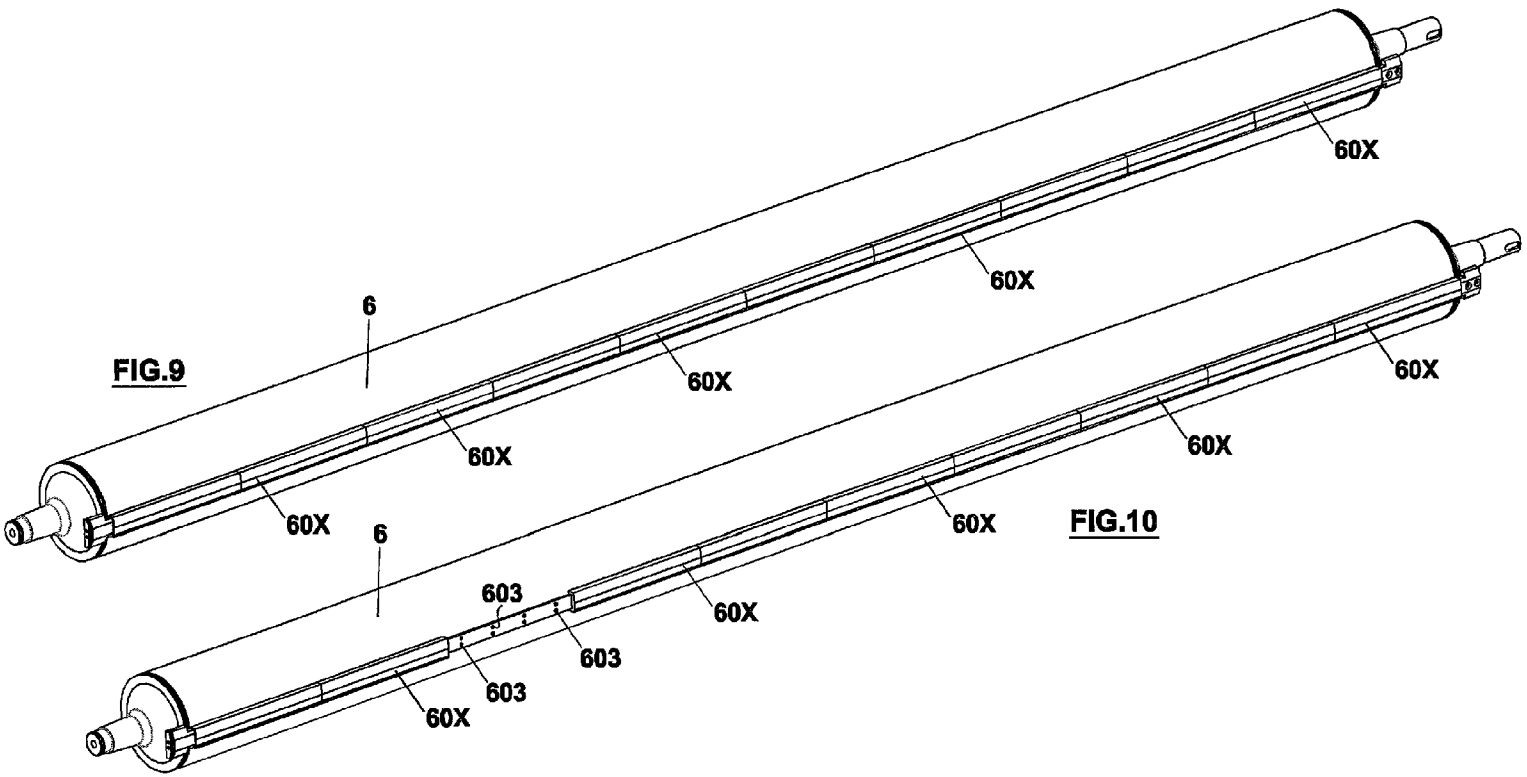
FIG. 9 is a schematic perspective view of a pad-holder roller made as shown in FIGS. 5-8.
FIG. 10 is a representation similar to FIG. 9 in which a portion of the pad and the plate (602) are not shown in order to better show the underlying springs (603).

The pad (60) can be a single body, extending longitudinally along the entire length of the roller (6). Alternatively, the pad (60) can be divided into several side-by-side portions (60X) as schematically shown in FIG. 7 and FIG. 9. The pad (60) can also be provided with reliefs suitably shaped for producing graphic effects on the web (2), in particular when the glue is colored glue.

In accordance with the present invention, it is possible to differentiate the type and/or viscosity, or the chemical characteristics of the glue dispensed by the first sizing means (the one intended to bond the web 2 on the core 1) with respect to the glue dispensed by the second sizing means (flap gluing glue).

Said first and second sizing means are synchronized with the winding means arranged in the winding station (W) in order to apply the glue on the first sheet of the log to be formed and respectively the glue in correspondence with the last sheet of the log being completed.

The application of the glue on the web (2) by the pad (60) is further disclosed below.

The pad (60) extends longitudinally on the pad-holder roller (6) such as to allow the distribution of the glue over the entire width of the web (2). As said above, the pad (60) can be a single body or it can be divided in several portions (60X). Therefore, it is possible to distribute the glue on the web (2) both continuously and discontinuously across the web. In other words, the distribution of the glue on the web can also extend discontinuously over the width of the web (2).

Preferably, in accordance with the present invention, the pad (60) is mounted elastically on the pad-holder roller (6). For example, with reference to the embodiment shown in FIGS. 5-10, the pad (60) is mounted on a radial appendix (600) of the roller (6) which has an internal side integral with the surface of the roller and an opposite external side on which a bracket (601) is formed; on the lower edges of the bracket a lower part (60L) of the pad (60) is hooked; the pad, seen in cross section, is substantially "C"-shaped and therefore has an internal surface (60G) facing the bracket (601). Between the inner face (60G) of the pad (60) and the bracket (601) is positioned a plate (602). Below the plate (602) are positioned elastic means (603), for example helical springs housed in suitable cavities (607) formed in the radial appendix (600) and oriented radially with respect to the roller (6).

In this way, depending on the state of compression of the pad (60), the latter can move elastically on the appendix (600) as schematically indicated by the double arrow "R60", i.e. in a radial or substantially radial direction with respect to the roller (6).

Figure 11:
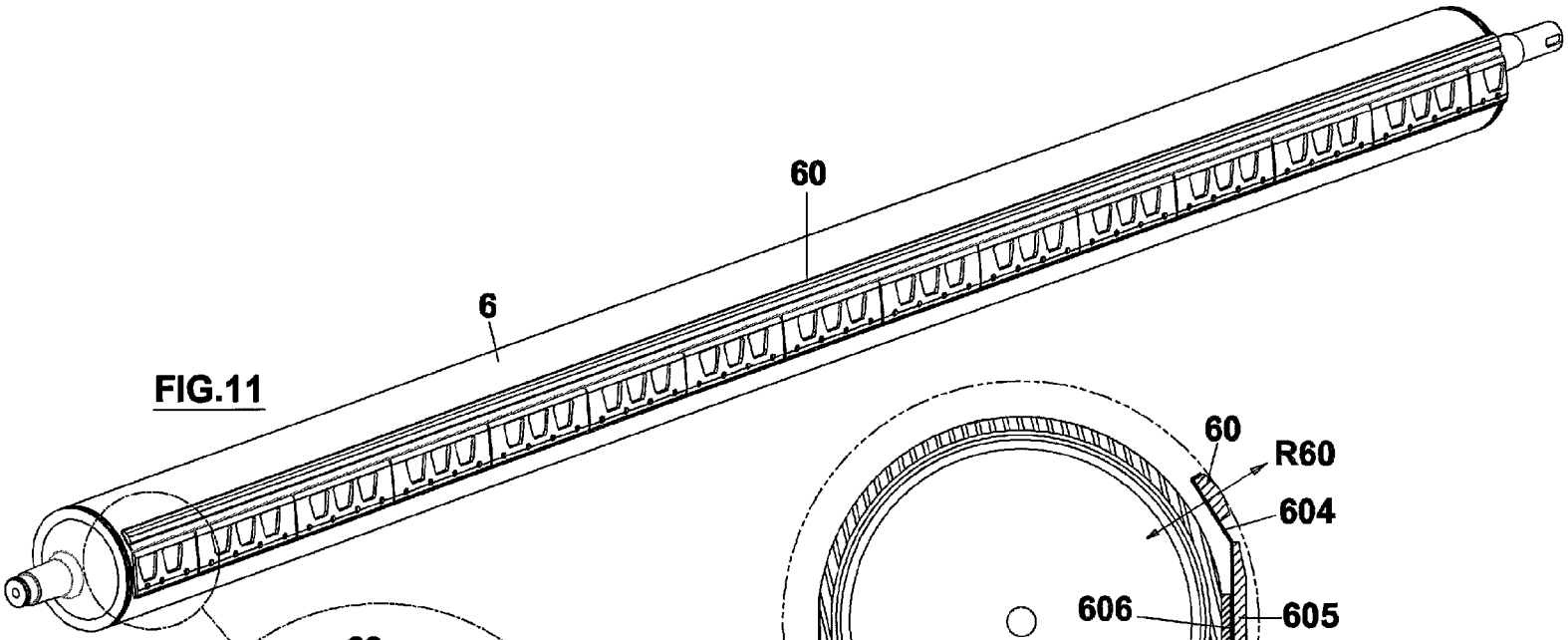
FIGS. 11-13 show a further embodiment of a pad-holder roller in accordance with the present invention.
Figure 13:
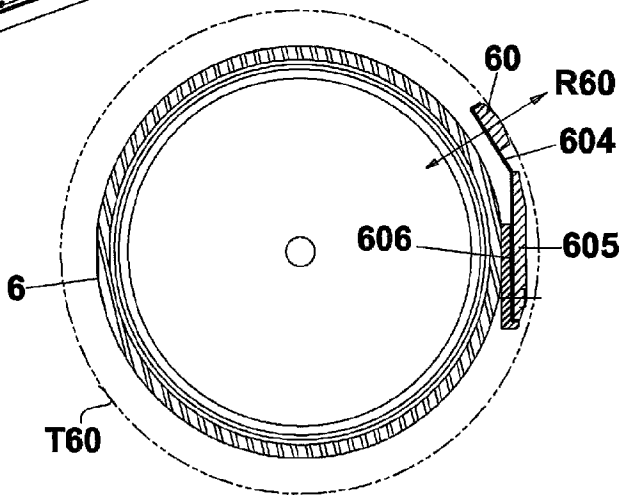
Figure 12:
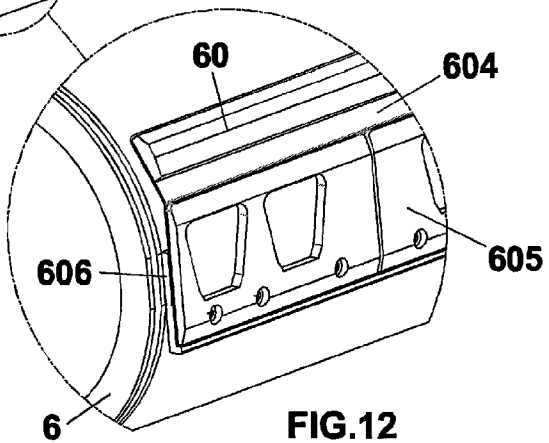

Alternatively, with reference to the embodiment illustrated in FIGS. 11-13, the pad (60) is mounted on a plate (604) which, on the opposite side, is clamped between two retaining blocks (605, 606) integral with the pad-holder roller (6). As shown in the drawings, in this case the pad (60) is on a free side of the aforementioned plate (side opposite to the side held by blocks 605, 606). Therefore, depending on the state of compression of the pad (60), the latter can move elastically to and from the roller (6) as schematically indicated by the double arrow "R60".

In accordance with both examples described above, the pad (60) is mounted on a support that moves elastically towards the pad-holder roller (6) when a pressure is exerted on the pad (60) and automatically moves in the opposite direction returning to its initial configuration when the pad (60) is unloaded, i.e. not subjected to pressure.

The pad (60) can be made, for example, of PTFE or Polyzene or Polyethylene, i.e. of a so-called anti-adherent plastic material having anti-adherent properties.

Advantageously, the actuator (61) is adapted to control the rotation of the pad (6) as described below.

In FIGS. 1-4 are shown four possible steps of a production method for the production of paper logs in accordance with the present invention.

FIG. 1 shows the pad (60) that has collected the glue from the anilox roller (70). The passage of the glue from the anilox roller (70) to the pad (60) takes place thanks to the contact between the pad and roller (70). In this step, a core (1) with a paper web layer (2) wound on it is in the winding station (W) where it is made to rotate by the rollers (R2), (R3) and (R4) in a manner known per se and therefore not described in detail; another core (1), already subjected to the action of the glue dispenser (8), is ready to be fed into channel (C). In the winding station (W) the paper of the web (2) continues to be wrapped around the core (1) positioned between the rollers of the winding station, thus forming the paper wrap (20) of the log being formed.

Figure 2:
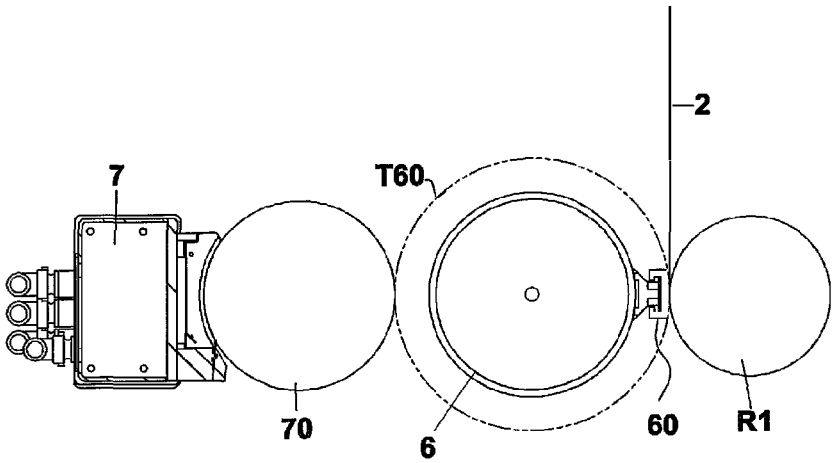
FIGS. 2-4 schematically show further operational configurations of the distribution unit of the glue upstream of the winding station of the machine shown in FIG. 1.

In FIG. 2 a subsequent process step is shown, in which the roller (6) carries the pad (60) in contact with the web (2) immediately upstream of the perforation which separates the last sheet of the log being completed and the first sheet of the next log to be produced. In this step, the peripheral speed of the pad (60) is lower than the speed of the web (2) directed towards the winding station (W). For example, the peripheral speed of the pad (60) has a value comprised between 20% and 50% of the speed of web (2). Preferably, in this step, the peripheral speed of the pad (60) has a value comprised between 30% and 40% of the speed of web (2) and even more preferably, a value comprised between 30% and 35% of the speed of web (2). Therefore, there is a more prolonged contact between the pad (60) and the web (2) which, therefore, collects from the pad (60) all, or substantially all, of the glue that the pad has previously collected from the glue feeding device (7, 70). Therefore, at the end of this step, i.e. when the pad (60) is no longer in contact with the web (2) because the roller (6) continues to rotate, the pad (60) is substantially dry. Consequently, a more prolonged contact between the pad (60) and the web (2) is obtained, and this drastically reduces the risk that the glue could drip due to gravity or be centrifugally projected from the pad, dirtying the surrounding areas of the machine, and prepares the pad for a more complete collection of glue in the next step since all or substantially all of the glue is transferred from the pad (60) to paper web (2). In other words, after contact with the paper web, the pad (60) is dry or substantially dry and this allows, in the next step of contact with the anilox roller, the most correct transfer of glue to the pad. This ensures a high accuracy of the distribution of the glue on the paper web during contact with the pad (60). By making use of a pad (60) placed on an elastic support, the transfer of glue from the pad to the web (2) is further favored.

Figure 3:
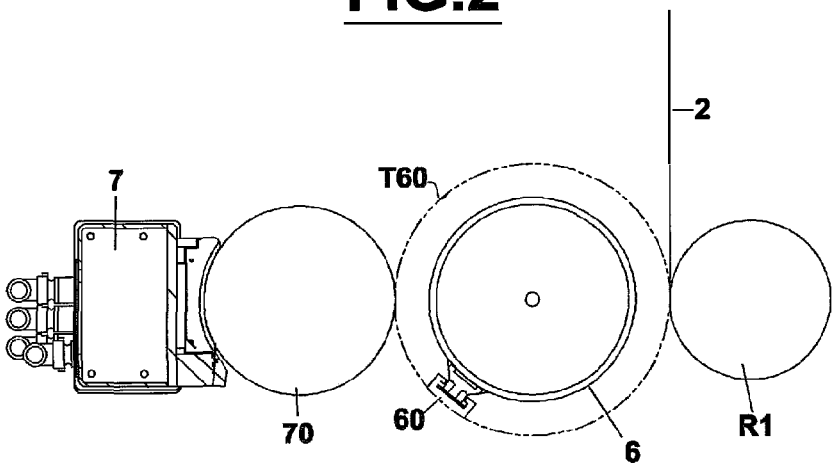
Figure 4:
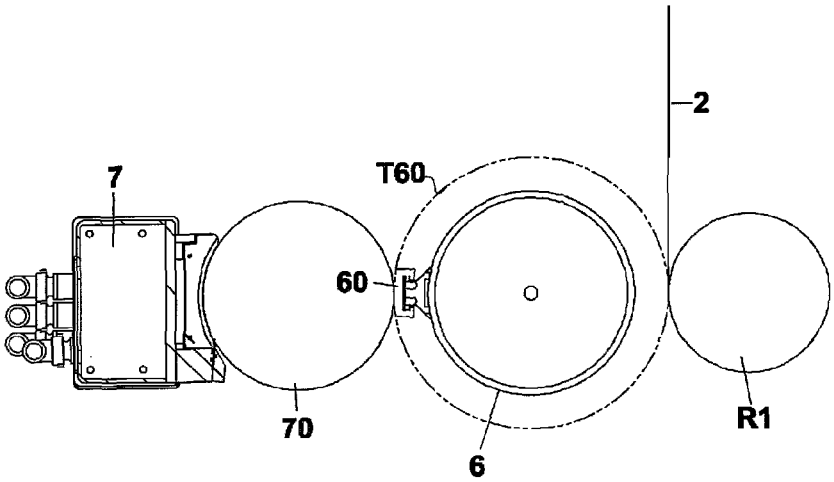
Figure 6:
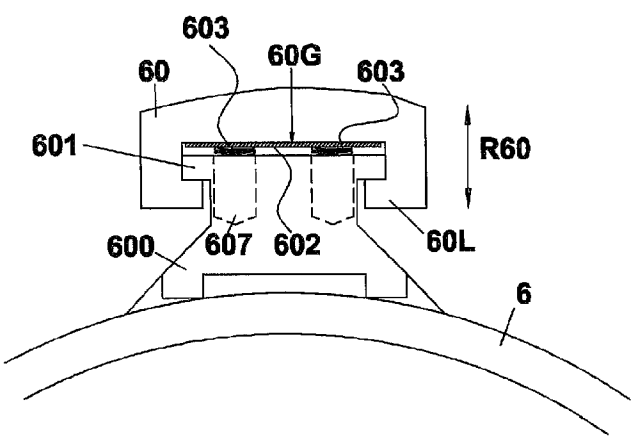
FIGS. 5-8 show, respectively, a schematic front view, an enlarged detail, a schematic side view and a cross section view according to line C-C of a pad-holder roller in accordance with a possible embodiment of the present invention.
Figure 5:
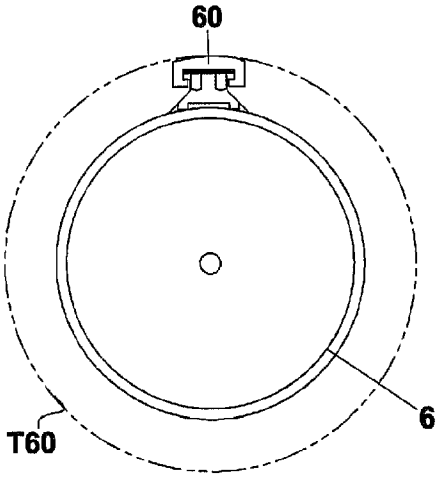

FIG. 3 shows the pad (60) in a waiting or an inoperative position upstream of the glue feeding device (7, 70). Therefore, cyclically, the roller (6) carries the pad (60) in the position of collecting the glue from the glue dispensing device (7, 70), then in the position of contact with the web (2) and finally in the inoperative position, so that the contact of the pad (60) with the web (2) is prolonged due to the aforementioned difference between the peripheral speed of the pad (60) and the speed of the web (2) directed towards the winding station (W). At the same time, a core (1) is introduced into the channel (C) and the mechanism (9) is activated to determine the separation of the sheets along the predetermined perforation line as previously mentioned. FIG. 4 shows the step of collecting the glue by the pad (60) in correspondence of the anilox roll (70).

The flap closing of the formed log and the removal of the latter from the winding station (W) takes place in a manner known to those skilled in the art and therefore not described in more detail. At this stage, the head end of the first sheet of the next log to be formed comes into contact with the core (1) on which the next log will be formed, joining to the same core thanks to the glue previously on the core. In practice, the web is interrupted thanks to the action of the mechanism formed by the nozzles (9) and the web ends thus obtained constitute respectively the tail end used for closing the flap of the formed log and the head end for starting the winding of the web on the core of the new log to be formed. As previously mentioned, the steps of preparing the web (2) for its winding on cores (1) and winding of the web on the cores in a machine of the type described above are known to those skilled in the art: the web (2), passing through a series of web-guide rollers (R5, R6, R7), reaches a pre-cutting station comprising the cutting rollers (30, 31) that produce, on the web (2), a series of pre-cutting lines which divide it into tear-off sheet. One of said pre cut lines is the one used by nozzles (9) in the winding station (W) to separate the tail of the downstream web (which defines the closing flap of the log being completed) from the head of the upstream web (which is glued to the core of the next log to be formed); the cores (1) are moved by the device (100) which carries them towards the coupling channel (C); in the passage through the device (100), each core (1) is subjected to the action of the glue dispenser (8) through a set of glue dispensing nozzles (80); the glue dispenser (8), according to the example shown in the drawings, represents said first sizing means for applying the glue, i.e. the means for dispensing the glue intended to bond the web (2) on the cores (1); once a core (1) has entered the channel (C), the glue dispensed on the core (1) determines its coupling with the first sheet, or head end, of the web (2) which reaches the channel because it is dragged around the roller (R2); the roller (R2), according to the example described, is provided with the web interrupting mechanism, which in the example described above is formed by the nozzles (9) provided inside the roller (R2), adapted to determine the detachment of the portion of the web (2) that has formed the log being completed and the portion of the web (2) that is going to form the next log.

More generally, the present invention is applicable to a rewinding machine comprising:

feeding means (R1, R5, R6, R7) for feeding a continuous paper web (2) along a predetermined path (F2) for feeding the paper web (2) with a predetermined feeding speed;

pre-cutting means (30, 31) adapted to provide a series of pre-cutting discontinuous transverse lines for dividing the web (2) into sheets of predetermined length;

winding means (R2, R3, R4), arranged in a winding station (W) located downstream of said web feeding means, adapted to wind the web (2) for making logs (20) of paper material;

sizing means arranged and acting along said feeding path (F2) of the web (2), with a glue application pad (60) adapted to cyclically apply glue by contact on the web (2) in the proximity of a pre-cutting line thereof, said pad (60) being mounted on a pad-holder device (6) connected with a corresponding actuator (61);

wherein said sizing means are arranged upstream of said winding station (W); and when the pad (60) is in contact with the web (2), the pad (60) is moved by the pad-holder device (6) with a lower speed then the speed with which the web (2) is fed along the respective feeding path (F2) so as to determine a prolonged contact of the pad (60) with the web (2) while both the pad (60) and the web (2) move.

Preferably, the speed of the pad (60) in contact with the web (2) has a value comprised between 20% and 50% of the speed of the web (2). More preferably, in this step, the peripheral speed of the pad (60) has a value of the speed of the web (2) and even more preferably, a value comprised between 30% and 35% of the speed of the web (2).

Advantageously, the pad-holder device (6) is a roller adapted to rotate around the respective longitudinal axis under the control of a respective actuator (61).

Furthermore, advantageously, when the pad (60) comes into contact with the web (2) the latter rests against a roller (R1) arranged along the aforementioned feeding path (F2) of web (2).

In accordance with the present invention, it is also advantageously provided that the pad (60) is mounted on the pad-holder device (6) by means of an elastic support which deforms elastically, such that the pad (60) moves elastically towards the pad-holder (6), when it is subjected to a pressure and moves automatically in the opposite direction returning to its configuration when the pad (60) is no longer subjected to a pressure.

The present invention is applicable both to rewinders that use tubular cores (1) for making logs (20), and rewinders that make logs of the "coreless" type, i.e. logs without an internal core.

If the rewinder (RW) is of the type that uses cores (1) for making logs, according to the example described above, it will be preferably equipped with:

means adapted for feeding tubular cores (1) along a predetermined further path (F1) which joins the first path (F2) at a coupling channel (C) in which the cores (1) are associated with said web (2), said channel (C) ending in said winding station (W);

means (8) for dispensing gluing on the cores, adapted to release glue on each core (1) along said further path (F1). From the description provided above, it results that a method for the production of logs of paper material in accordance with the present invention comprises the following steps:

feeding a continuous paper web (2) along a corresponding predetermined web feeding path (F2) with a predetermined feeding speed;

providing a series of pre-cutting discontinuous transverse lines for dividing the web (2) into sheets of predetermined length to be separated by tear;

in a winding station (W), winding the web (2) to make paper logs (20);

providing sizing means along said web feeding path (F2), with a glue application pad (60) able to apply cyclically glue by contact on the web (2) in proximity of a pre-cutting line thereof, said pad (60) being mounted on a pad-holder device (6);

and said sizing means are arranged upstream of said winding station (W); and when the pad (60) is in contact with the web (2), the pad (60) is moved by the pad-holder device (6) with a speed lower than the speed at which the web (2) is fed along the respective feeding path (F2) so as to determine a prolonged contact of the pad (60) with the web (2) while both the pad (60) and the web (2) move.

Preferably, the speed of the pad (60) in contact with the web (2) has a value comprised between 20% and 50% of the speed of the web (2).

More preferably, in this step, the peripheral speed of the pad (60) has a value comprised between 30% and 40% of the speed of the web (2) and yet more preferably, a value comprised between 30% and 35% of the speed of the web (2). Furthermore, preferably, the pad (60) is mounted on the pad-holder (6) by means of an elastic support which deforms elastically such that the pad (60) moves elastically towards the pad-holder device when it is subjected to pressure and it automatically moves in the opposite direction returning to its configuration when it is unloaded.

In accordance with an embodiment which foresees the use of tubular cores (1) for making the logs (20), a method according to the present invention also includes the following steps:

feeding tubular cores (1) along a further predetermined path (F1) which joins said feeding path (F2) of the web (2) in correspondence of a coupling channel (C) in which said cores (1) are associated with said web (2), said channel (C) being arranged upstream of said winding station (W) where on each of said cores (1) a predetermined amount of said web (2) is wound;

by means of further glue dispensing means (8), dispensing glue on each core (1);

arranging said further glue dispensing means along said further predetermined path, upstream of said coupling channel (C).

According to the example shown in the drawings, the sizing means intended to apply the glue to the web (2) upstream of the winding station (W) are arranged at a given distance from the winding station at a point where the web (2) has not yet reached the winding station, i.e. the first winding roller (R2).

In practice, however, the details of execution may vary in an equivalent manner with regard to the individual elements described and illustrated and their reciprocal arrangement without going beyond the scope of the idea of solution adopted and therefore remaining within the limits of the protection conferred by this patent in accordance with the following claims.

The invention claimed is:

1. A rewinding machine for the production of paper logs obtained by winding a paper web, comprising:

feeding means for feeding a continuous paper web along a predetermined web feeding path for feeding the paper web with a predetermined feeding speed;

pre-cutting means adapted to provide a series of pre-cutting discontinuous transverse lines for dividing the web into sheets of predetermined length;

winding means, arranged in a winding station located downstream of said web feeding means, the winding station having an inlet for the continuous paper web, the winding means being adapted to wind the web for making logs of paper material, the winding means comprising a predetermined number of winding rollers arranged along said web feeding path such that one winding roller of the predetermined number of winding rollers is at the inlet of the winding station; and sizing means arranged and acting along said web feeding path, the sizing means comprising a glue application pad adapted to cyclically apply glue by contact on the web in the proximity of a pre-cutting line thereof, said pad being mounted on a pad-holder device connected with a corresponding actuator;

wherein—said sizing means are arranged upstream of said inlet of the winding station; and said pad-holder device is controlled by the respective actuator such that, when the pad is in contact with the web, the pad is moved by the pad-holder device with a speed lower than the feeding speed of the web along the web feeding path so as to cause a prolonged contact of the pad with the web while the pad and the web move.

2. The rewinding machine according to claim 1, wherein the speed of the pad in contact with the web has a value comprised between 20% and 50% of the web feeding speed.

3. The rewinding machine according to claim 1, wherein the pad-holder device is a roller adapted to rotate around a corresponding longitudinal axis under the control of the respective actuator and in that the pad protrudes radially from the roller.

4. The rewinding machine according to claim 1, further comprising a roller, arranged along said feeding path, on which the web rests during contact with the pad.

5. The rewinding machine according to claim 1, wherein said pad is mounted on the pad-holder device by an elastic support that deforms elastically such that the pad moves elastically towards the pad-holder device when is subjected to pressure and moves automatically in the opposite direction returning to its initial configuration when is not subjected to pressure.

6. The rewinding machine according to claim 5, wherein the pad is mounted on springs.

7. The rewinding machine according to claim 5, wherein the pad is mounted on a flexible plate.

8. The rewinding machine according to claim 1, further comprising:

means for feeding the tubular cores along a further predetermined path which joins said first path at a coupling channel in which the cores are associated with said web, said channel ending in said winding station; and means for sizing the cores adapted to release glue on each core along said further path.

9. A method for the production of paper material logs, comprising:

feeding a continuous paper web along a predetermined web feeding path with a predetermined feeding speed;

providing a series of pre-cutting discontinuous transverse lines for dividing the web into sheets of predetermined length to be separated by tear;

in a winding station located downstream of said web feeding means, winding the web to make paper logs by winding means, the winding station having an inlet for the continuous paper web, the winding means being adapted to wind the web for making logs of paper material, the winding means comprising a predetermined number of winding rollers arranged along said web feeding path such that one winding roller of the predetermined number of winding rollers is at the inlet of the winding station; and providing sizing means along said web feeding path, the sizing means comprising a glue application pad configured to cyclically apply glue by contact on the web in proximity of a pre-cutting line thereof, said pad being mounted on a pad-holder device;

wherein said sizing means are provided upstream of said inlet of the winding station; and when the pad is in contact with the web, the pad is moved by the pad-holder device with a speed lower than the speed at which the web is fed along the respective feeding path so as to determine a prolonged contact of the pad with the web while both the pad and the web move.

10. The method for the production of paper material logs according to claim 9, wherein the speed of the pad in contact with the web has a value comprised between 20% and 50% of the web feeding speed.

11. The method for the production of paper material logs according to claim 9, further comprising:

feeding tubular cores along a further predetermined path which joins said web feeding path at a coupling channel where said cores are associated with the web, said channel being arranged upstream of said winding station (W) where a predetermined amount of said web is wound on each of said cores;

by means of further glue releasing means, releasing glue on each core; and providing said further glue releasing means along said further predetermined path, upstream of said coupling channel.

12. The method for the production of paper material logs according to claim 9, wherein said pad moves elastically with respect to the pad-holder device.

* * * * *